US012514384B2

(12) United States Patent
Mandelcorn et al.

(10) Patent No.: US 12,514,384 B2
(45) Date of Patent: Jan. 6, 2026

(54) MERCHANDISER WITH SUPPLEMENTAL AIR RETURN

(71) Applicant: Hussmann Corporation, Bridgeton, MO (US)

(72) Inventors: Timothy K. Mandelcorn, Rancho Cucamonga, CA (US); Michael A. Gillett, Perris, CA (US); Eric J. Melton, Alta Loma, CA (US)

(73) Assignee: HUSSMANN CORPORATION, Bridgeton, MO (US)

( * ) Notice: Subject to any disclaimer, the term of this patent is extended or adjusted under 35 U.S.C. 154(b) by 223 days.

(21) Appl. No.: 18/327,758

(22) Filed: Jun. 1, 2023

(65) Prior Publication Data

US 2023/0389721 A1 Dec. 7, 2023

Related U.S. Application Data

(60) Provisional application No. 63/348,601, filed on Jun. 3, 2022.

(51) Int. Cl.
*A47F 3/04* (2006.01)

(52) U.S. Cl.
CPC ..... *A47F 3/0452* (2013.01); *A47F 3/0447* (2013.01); *A47F 2003/046* (2013.01)

(58) Field of Classification Search
CPC . A47F 3/0452; A47F 3/0447; A47F 2003/046
See application file for complete search history.

(56) References Cited

U.S. PATENT DOCUMENTS

| | | | | |
|---|---|---|---|---|
| 3,063,253 | A * | 11/1962 | Dickson et al. | A47F 3/0447 62/256 |
| 3,103,796 | A * | 9/1963 | Weber et al. | F25D 21/06 62/234 |
| 3,304,736 | A | 2/1967 | Brennan et al. | |
| 3,369,375 | A | 2/1968 | Gerweck et al. | |
| 3,420,070 | A | 1/1969 | Hermanson | |
| 4,144,720 | A | 3/1979 | Subera et al. | |
| 4,207,747 | A | 6/1980 | Subera et al. | |
| 4,265,092 | A | 5/1981 | Abraham | |
| 4,283,922 | A | 8/1981 | Subera et al. | |

(Continued)

*Primary Examiner* — Jerry-Daryl Fletcher
*Assistant Examiner* — Dario Antonio Deleon
(74) *Attorney, Agent, or Firm* — Michael Best & Friedrich LLP

(57) ABSTRACT

The present invention provides a merchandiser including a case defining primary and secondary air passageways, a first fan, and an evaporator. The case includes a base having first and second air inlets, one or more walls, and a canopy cooperatively defining a product display area accessible through an opening. The evaporator is disposed in the base. A first fan is disposed in the case and generates a primary airflow through the primary air passageway. The first fan, or a second fan, generates a secondary airflow through the secondary air passageway. Air from the product display area, air outlet, or both entering the first air inlet at least partially defines the first airflow which flows through the evaporator via the primary air passageway. The secondary airflow flows through the evaporator and is at least partially defined by air flowing past the first air inlet and entering the second air inlet.

20 Claims, 5 Drawing Sheets

(56) References Cited

U.S. PATENT DOCUMENTS

| | | | | |
|---|---|---|---|---|
| 4,320,631 | A | 3/1982 | Vana | |
| 4,389,852 | A | 6/1983 | Abraham | |
| 4,648,247 | A * | 3/1987 | Takizawa et al. .... | F25B 47/022 62/256 |
| 4,938,034 | A * | 7/1990 | Rosanio et al. ..... | A47F 3/0447 62/256 |
| 7,062,932 | B2 | 6/2006 | Downs | |
| 7,216,494 | B2 | 5/2007 | Thurman | |
| 8,359,876 | B2 | 1/2013 | Esformes | |
| 8,647,183 | B2 | 2/2014 | Swofford | |
| 10,368,659 | B2 | 8/2019 | Resch | |
| 10,368,660 | B2 | 8/2019 | Vonberg et al. | |
| 10,548,415 | B2 | 2/2020 | Hirano | |
| 2007/0012059 | A1 * | 1/2007 | Roche et al. ..... | A47F 3/0447 62/256 |
| 2009/0255286 | A1 | 10/2009 | Solsona Caballer et al. | |
| 2011/0314857 | A1 | 12/2011 | Berben et al. | |
| 2017/0208967 | A1 | 7/2017 | Wirth | |
| 2022/0071411 | A1 * | 3/2022 | Mcandrew ..... | A47F 3/0447 |

* cited by examiner

MERCHANDISER WITH SUPPLEMENTAL AIR RETURN

CROSS-REFERENCE TO RELATED APPLICATIONS

This application claims priority to U.S. Provisional Application No. 63/348,601, filed on Jun. 3, 2022, the entire content of which is incorporated herein by reference.

BACKGROUND OF THE INVENTION

The present invention relates to a merchandiser and, in particular, a merchandiser with a supplemental air return.

Generally, a refrigerated merchandiser uses a forced air convection system with a heat exchanger assembly including one or more evaporator coils and one or more fans to force a volume of air over the evaporator coil. Cooled air is directed through a passageway in the merchandiser to provide cooling to the product display area. Circulation of cooled air in the product display area results in a zone of lower pressure in the product display area compared to the air surrounding the merchandiser. The low-pressure zone is present to one degree or another in open-front merchandisers including both full-size and countertop merchandisers. The low-pressure zone pulls warmer, ambient air into the merchandiser in a process called low-pressure infiltration. This low-pressure infiltration results in the temperature of the air in the case increasing, and eventually, exceeding the maximum safe food storage temperature.

To reduce the effects of low-pressure infiltration, merchandisers typically generate one or more cooled or refrigerated air curtains across the open front of the case. In existing open-front merchandisers, some air from the air curtain spills over the lower part of the case rather than entering, or re-entering, the merchandiser via the air inlet in the base. Spill-over air reduces the efficiency of the merchandiser.

SUMMARY

The present invention provides, in one aspect, a merchandiser including a case that defines a primary and a secondary air passageway. The case includes a base, one or more walls, and a canopy that cooperatively at least partially define a product display area and an opening though which the product display is accessible. An evaporator is disposed in the base. The base has first and second air inlets. The canopy has an air outlet disposed adjacent the opening. A first fan disposed in the case generates a primary airflow through the primary air passageway. The first fan, or a second fan, are configured to generate a secondary airflow through the secondary air passageway. The primary airflow is at least partially defined by air from the product display area or the air outlet, or both, entering the first air inlet and configured to flow through the evaporator via the primary air passageway. The secondary airflow is at least partially defined by air flowing past the first air inlet and entering the second air inlet, and the secondary airflow is configured to flow through the evaporator.

The present invention provides, in another aspect, an air foil coupled to the base upstream of the second air inlet.

The present invention provides, in another aspect, a merchandiser including a case that defines a primary and a secondary air passageway. The case includes a base, one or more walls, and a canopy that cooperatively at least partially define a product display area and an opening though which the product display is accessible. The base includes first and second air inlets. The base has first and second air inlets. The canopy has an air outlet disposed adjacent the opening. An evaporator is disposed in the case. A first fan is disposed in the case and is configured to generate a primary airflow through the primary passageway. The first fan, or a second fan is configured to generate a secondary airflow through the secondary air passageway. The primary and secondary airflows combine within the case to define a merged airflow at a location upstream of the air outlet and downstream of the evaporator. The primary airflow is at least partially defined by air from the product display area or the air outlet, or both, entering the first air inlet and configured to flow through the evaporator via the primary air passageway. The secondary airflow is at least partially defined by air flowing past the first air inlet and entering the second air inlet.

The present invention provides, in another aspect, a merchandiser including a case that defines a primary and a secondary airflow passageway. The case includes a base, one or more walls, and a canopy that cooperatively at least partially define a product display area and an opening though which the product display is accessible. The base has first and second air inlets. The canopy has an air outlet disposed adjacent the opening. An evaporator is disposed in the base. A first fan is disposed in the primary air passageway and is configured to generate a primary airflow through the primary passageway. The primary airflow is at least partially defined by air from the product display area entering the first inlet and is configured to flow through the evaporator via the primary air passageway. A second fan is disposed in the secondary air passageway and is configured to generate a secondary airflow through the secondary air passageway. The secondary air passageway communicates with the second air outlet and is positioned to receive spillover air flowing from the product display area or the air outlet along the front portion of the base via the second air inlet. The secondary air passageway is positioned in the base such that the secondary airflow is configured to flow through the evaporator.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
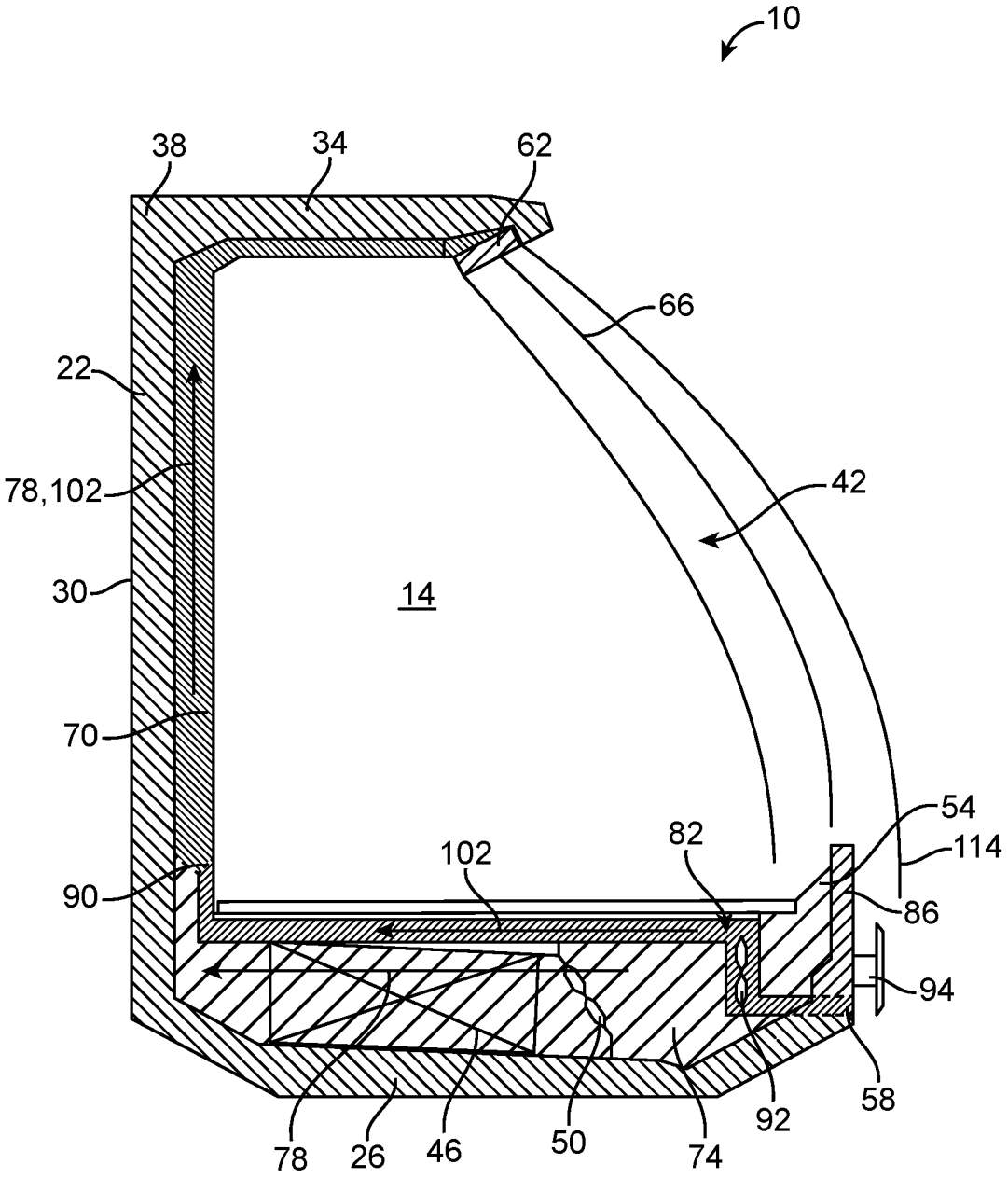
FIG. 1 is a schematic of a merchandiser embodying the invention and including a base defining a primary passageway and a secondary passageway.

FIG. 1 illustrates an exemplary merchandiser 10 for displaying product in a product display area 14 that is maintained at or below a desired air temperature consistent with proper food storage standards. The merchandiser 10 may include shelves 18 (shown in FIG. 5) coupled to the merchandiser 10 and positioned in the product display area 14 for display of refrigerated items. The merchandiser 10 includes a case 22 that has a base 26, a back wall 30, side walls (not shown), and a canopy 34, which partially enclose the product display area 14. The base 26, back wall 30, side walls, and canopy 34 may include an insulating medium 38 to reduce heat transfer into the product display area 14 from outside the case 22 and more efficiently maintain the air temperature in the product display area 14. The base 26, back wall 30, side walls, and canopy 34 define an opening 42 through which a customer can access items displayed in the product display area 14.

The case 22 supports at least a portion of a refrigeration system (e.g., an evaporator 46 and a fan 50) and defines a first, or primary, air inlet 54 and a secondary air inlet 58 in the base 26, and an air outlet 62 in the canopy 34 to direct or circulate air that is cooled or refrigerated by the refrigeration system across the opening 42 in the form of an air curtain 66. Additional airflow may be delivered via one or more openings in a panel 70 coupled to the back wall 30.

With continued reference to FIG. 1, the merchandiser 10 includes a primary air passageway 74 (hereinafter "primary passageway") that interconnects the primary air inlet 54 to the air outlet 62. The evaporator 46 and the fan 50 are located in the primary passageway 74 (e.g., in the base 26) to cool a primary airflow 78. As illustrated, the fan 50 is located in the primary passageway 74 between the primary air inlet 54 and the evaporator 46. The evaporator 46 may instead by located in in the primary passageway 74 between the primary air inlet 54 and the fan 50. The fan 50 may be an axial fan, centrifugal fan, or other fan configured to generate the primary airflow 78 through the primary passageway 74.

The merchandiser 10 also includes a secondary air passageway 82 (hereinafter "secondary passageway") that is defined in the base 26 and that has a secondary air inlet 58 adjacent a front portion 86 of the base 26. The secondary passageway 82 extends from the secondary air inlet 58 through the base 26 to a secondary air outlet 90 that merges with the primary passageway 74. The secondary air outlet 90 is disposed adjacent the panel 70 coupled to the back wall 30 between the base 26 and the canopy 34, although the merger of airflow may occur anywhere in the case 22 upstream or downstream of the evaporator 46. In some embodiments, the secondary passageway 82 may remain completely separate from the primary passageway 74. As shown in FIG. 1, the secondary passageway 82 extends through the base 26 adjacent to, but not through, the evaporator 46. A secondary fan 92 (e.g., an axial fan, centrifugal fan, or other fan) is positioned in the secondary passageway 82. An airfoil 94 may be coupled to the front portion 86 of the base 26 adjacent the secondary air inlet 58. The airfoil 94 extends outward from the merchandiser 10 to redirect air into the secondary passageway 82

Figure 2:
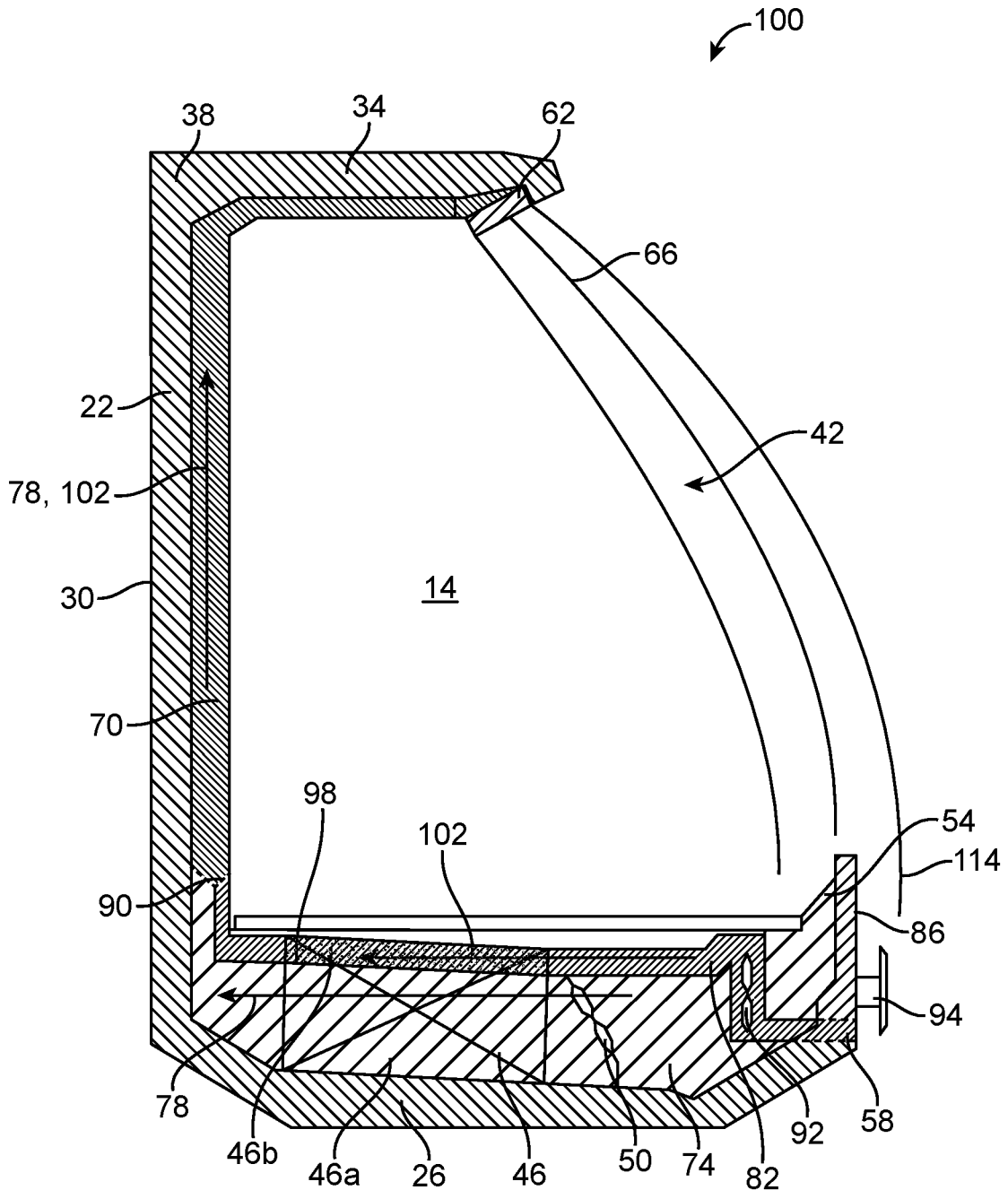
FIG. 2 is a schematic of another merchandiser embodying the invention and including a base defining a primary passageway and a secondary passageway.
Figure 3:
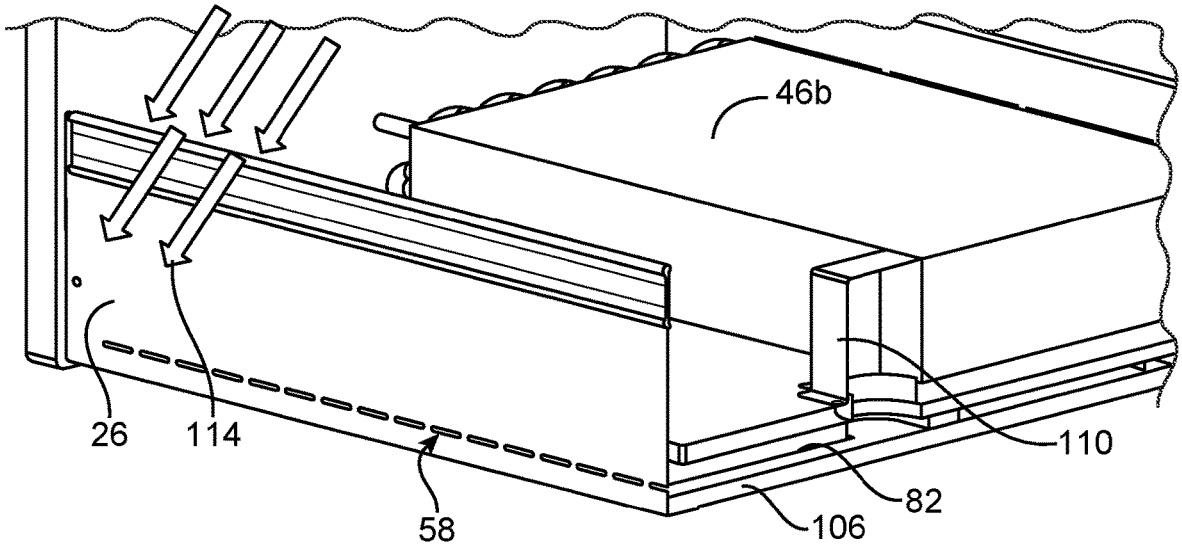
FIG. 3 is a perspective view of a portion the base of the merchandiser of FIG. 2 illustrating the present invention.
Figure 4:
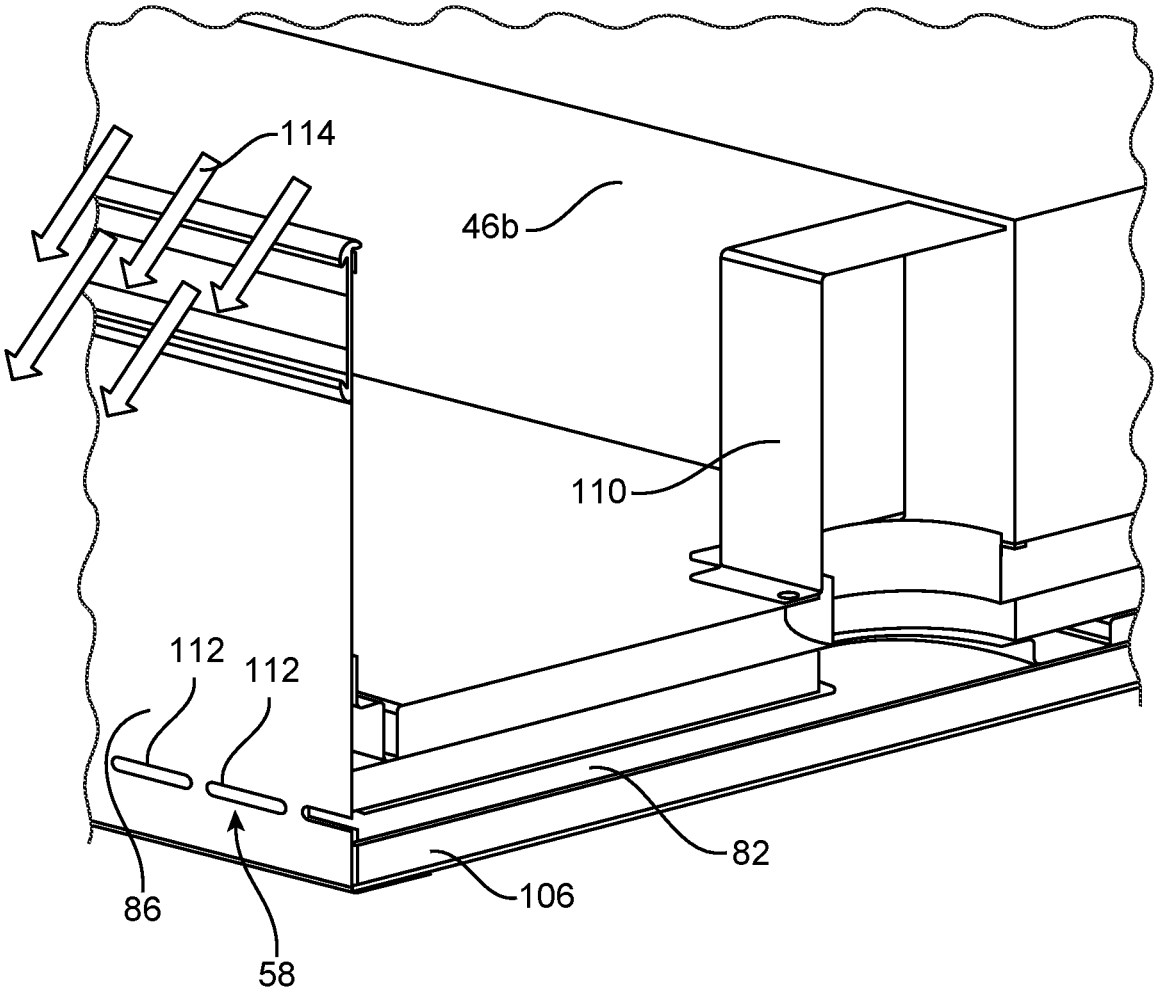
FIG. 4 is an enlarged perspective view of the base of the merchandiser of FIG. 3.

FIGS. 2-4 illustrate another exemplary merchandiser 100 embodying the invention. Except as described below, the merchandiser 100 is the same as the merchandiser 10 and similar features are identified with the same reference numerals. As shown, the merchandiser 10 includes the case 22 and the canopy 34 that partially enclose the product display area 14. The base 26, back wall 30, side walls, and canopy 34 may include an insulating medium 38 to reduce heat transfer into the product display area 14 from outside the case 22 and more efficiently maintain the air temperature in the product display area 14.

The case 22 supports at least a portion of a refrigeration system (e.g., the evaporator 46 and the fan 50) and defines a primary air inlet 54 and a secondary air inlet 58 in the base 26, and an air outlet 62 in the canopy 34 to direct or circulate air that is cooled or refrigerated by the refrigeration system across the opening 42 in the form of an air curtain 66. Additional airflow may be delivered via one or more openings in a panel 70 coupled to the back wall 30. As best shown in FIG. 2, the evaporator 46 has a first section **46*a* and a second section 46*b* that are separated by a partition 98. The first and second sections 46*a*, 46*b* may have the same internal features and dimensioning, such as evaporator tube orientation and spacing, fin size and spacing, and other considerations that affect the cooling capacity of the evaporator 46. In some embodiments (e.g., the embodiment of FIG. 5), internal features and dimensioning of the evaporator 46 may differ in one or more aspects between the first and second sections 46*a*, 46*b***.

With continued reference to FIG. 2, the illustrated merchandiser 100 includes the primary passageway 74 that interconnects a primary air inlet 54 defined in the base 26 to an air outlet 62 defined in the canopy 34. The first section **46*a* of the evaporator 46 is disposed in the primary passageway 74 to cool a primary airflow 78. The fan 50 is located in the primary passageway 74 to generate and direct the primary airflow 78 over the first section 46*a* of the evaporator 46. As illustrated, the fan 50 is located in the primary passageway 74 between the primary air inlet 54 and the first section 46*a*. The first section 46*a* of the evaporator 46 may instead by located in the primary passageway 74 between the primary air inlet 54 and the fan 50**.

Figure 5:
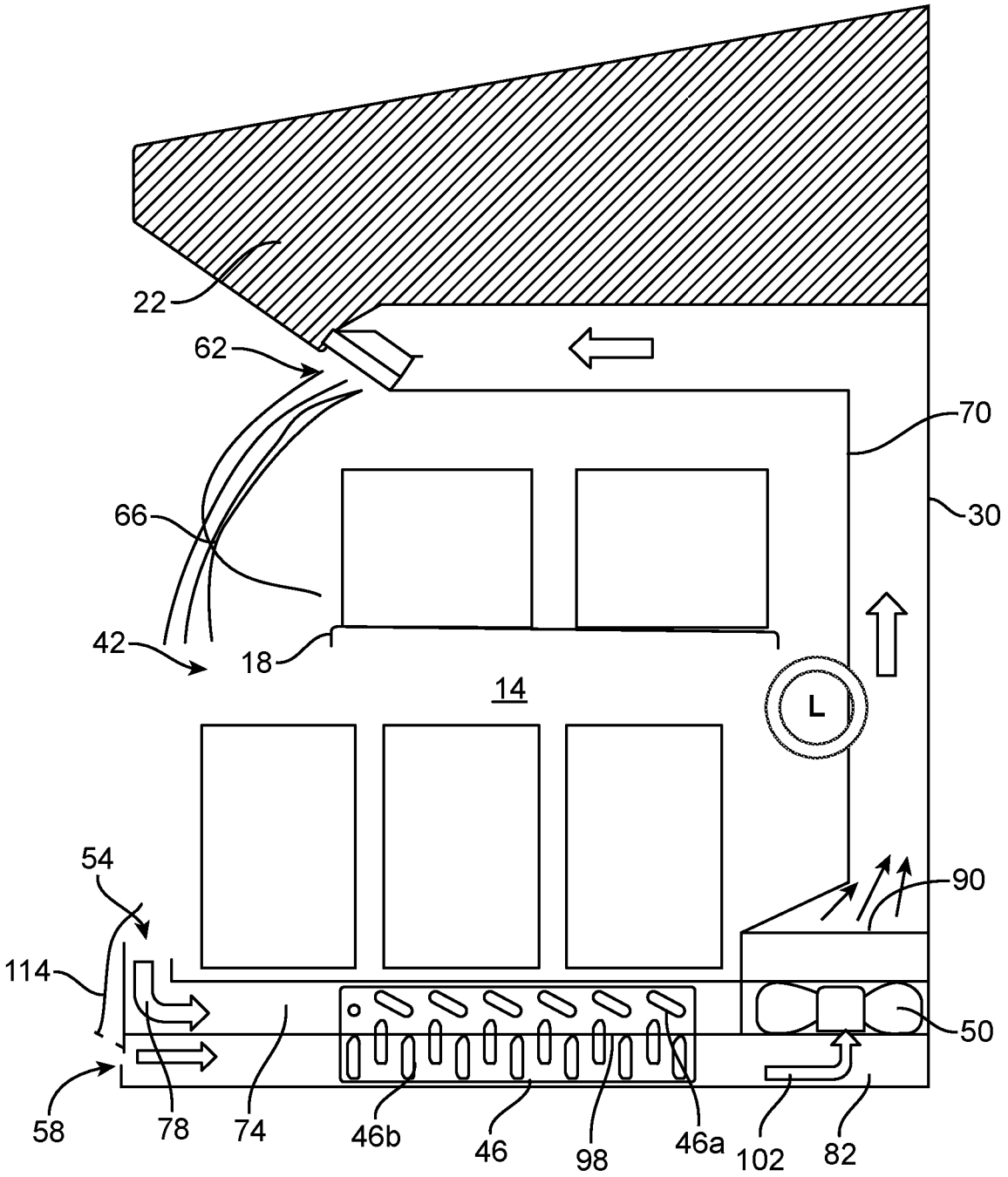
FIG. 5 is a schematic of another merchandiser embodying the invention and including a base defining primary passageway and a secondary passageway.

The merchandiser 100 also includes the secondary passageway 82 that is defined in the base 26 and that has the secondary air inlet 58 adjacent a front portion 86 of the base 26. The second section **46*b* of the evaporator 46 is disposed in the secondary passageway 82 to cool the secondary airflow 102 directed across the evaporator 46. The secondary fan 92 is positioned in the secondary passageway 82 and generates and directs the secondary airflow 102 to and across the second section 46*b* of the evaporator. As illustrated in FIG. 2, the secondary fan 92 is positioned between the secondary air inlet 58 and the second section 46*b* of the evaporator 46, although the second section 46*b* may be positioned between the secondary air inlet 58 and the secondary fan 92 as illustrated in FIG. 5. Similarly, and with reference to FIG. 5, one fan 50 or fan set may be used to produce the primary and secondary airflows 78, 102. The secondary passageway 82 extends from the secondary air inlet 58 through the base 26 to the secondary air outlet 90. The airfoil 94 may be coupled to the front portion 86 of the base 26 adjacent to the secondary air inlet 58. The airfoil 94 extends outward from the merchandiser 10**.

One of the differences between the merchandiser 10 and the merchandiser 100 relates to the secondary passageway 82 passing through a portion of the evaporator 46. With reference to FIGS. 3 and 4, the secondary passageway 82 may include insulation 106 (e.g., an insulating material such as fiberglass, polyurethane foam, or other material formed as a sheet, tube, etc.) disposed around or on sides of the secondary passageway 82 to limit heat transfer between the secondary airflow 102 in the secondary passageway 82 and the surrounding environment (e.g., the case 22, the ambient environment, etc.). The secondary passageway 82 is coupled to and extends through the second section 46*b* of the evaporator 46 via an evaporator return cover 110 that directs the secondary airflow 102 into the evaporator 46. As illustrated, the secondary air inlet 58 includes a plurality of openings 112 (e.g., obround, rectangular, circular, or other shape to facilitate air ingress) along a front of the base 26, although the secondary air inlet 58 may be one continuous opening or may be defined by different-sized and/or shaped openings. As best seen in FIG. 4, the secondary airflow 102 changes direction within the case 22 prior to entering the evaporator 46 although, in some embodiments, the secondary airflow 102 may extend substantially linearly from the secondary air inlet 58 to and/or through the evaporator 46.

In operation of the merchandiser 10 and the merchandiser 100, at least some refrigerated air from the product display area 14 is collected via the primary air inlet 54 of the base 26, which is assisted by the fan 50 in the primary passageway 74 that produces the primary airflow 78 that is directed through the evaporator 46 and the remainder of the primary passageway 74. Spill-over air 114, which may include air from the product display area 14 or a combination of air from the product display area 14 and ambient air adjacent the base 26, is reclaimed through the secondary air inlet 58 positioned at the front portion 86 of the base 26. As illustrated in FIGS. 1 and 2, the airfoil 94 directs the spill-over air 114 to the secondary air inlet 58. The spill-over air 114 enters the secondary passageway 82 through the secondary air inlet 58 via operation of the secondary fan 92, which produces the secondary airflow 102 through the secondary passageway 82. In the exemplary merchandiser 10 of FIG. 1, the secondary airflow 102 bypasses the evaporator 46 prior to merging with the primary airflow 78. In the exemplary merchandiser 100 of FIG. 2, the secondary airflow 102 is directed through the second section 46*b* of the evaporator 46 before merging with the primary airflow 78. The merged primary and secondary airflows 78, 102 are directed into the product display area 14 through the panel 70 coupled to the back wall 30, and/or continue to flow through the primary passageway 74 to the air outlet 62 where the merged primary and secondary airflows 78, 102 are introduced as an air curtain 66 directed across the opening 42 of the merchandiser 10, 100.

The invention claimed is:

1. A merchandiser comprising:

a case defining a primary air passageway and a secondary air passageway, the case including a base, one or more walls, and a canopy cooperatively at least partially defining a product display area and an opening through which the product display area is accessible, the base having a first air inlet and a second air inlet, and the canopy having an air outlet disposed adjacent the opening;

a first fan disposed in the case and configured to generate a primary airflow through the primary air passageway, and the first fan or a second fan configured to generate a secondary airflow through the secondary air passageway; and an evaporator disposed in the base, wherein the primary airflow is at least partially defined by air from the product display area or the air outlet, or both, entering the first air inlet, and the primary airflow configured to flow through the evaporator via the primary air passageway, wherein the secondary airflow is at least partially defined by air flowing past the first air inlet and entering the second air inlet, and wherein the secondary airflow is configured to flow through the evaporator.

2. The merchandiser of claim 1, wherein the evaporator includes a partition defining a first section and a second section, wherein the first section is disposed in the primary air passageway and the second section is disposed in the secondary air passageway.

3. The merchandiser of claim 2, wherein the first fan is configured to generate the primary airflow and the second fan is configured to generate the secondary airflow.

4. The merchandiser of claim 1, further comprising an airfoil coupled to the base adjacent and upstream of the second air inlet to guide air to the second air inlet.

5. The merchandiser of claim 1, wherein the first fan is disposed downstream of the evaporator and is configured to generate the primary airflow and the secondary airflow.

6. The merchandiser of claim 1, wherein the primary airflow and the secondary airflow merge within the case upstream of the air outlet.

7. The merchandiser of claim 1, further comprising insulation at least partially surrounding the secondary air passageway.

8. The merchandiser of claim 1, wherein the first fan is positioned in the primary air passageway and the second fan is positioned in the secondary air passageway.

9. The merchandiser of claim 8, wherein the first fan is positioned upstream of the evaporator.

10. The merchandiser of claim 8, wherein the second fan is positioned upstream of the evaporator.

11. A merchandiser comprising:

a case defining a primary air passageway and a secondary air passageway, the case including a base, one or more walls, and a canopy cooperatively at least partially defining a product display area and an opening through which the product display area is accessible, the base having a first air inlet and a second air inlet, and the canopy having an air outlet disposed adjacent the opening;

a first fan disposed in the case and configured to generate a primary airflow through the primary air passageway, the first fan or a second fan configured to generate a secondary airflow through the secondary air passageway; and an evaporator disposed in the case, wherein the primary airflow and the secondary airflow combine within the case to define a merged airflow at a location upstream of the air outlet and downstream of the evaporator, wherein the primary airflow is at least partially defined by air from the product display area or the air outlet, or both, entering the first air inlet, and the primary airflow is configured to flow through the evaporator via the primary air passageway, and wherein the secondary airflow is at least partially defined by air flowing past the first air inlet and entering the second air inlet.

12. The merchandiser of claim 11, wherein the secondary airflow is configured to flow through the evaporator.

13. The merchandiser of claim 11, wherein the evaporator includes a partition defining a first section and a second section, wherein the first section is disposed in the primary air passageway and the second section is disposed in the secondary air passageway.

14. The merchandiser of claim 13, wherein the first section includes an internal structure defined by one or more of an evaporator tube orientation, an evaporator tube spacing, a fin size, or a fin spacing, wherein the second section includes an internal structure defined by one or more of an evaporator tube orientation, an evaporator tube spacing, a fin size, or a fin spacing, and wherein the internal structure of the first section is different from the internal structure of the second section.

15. The merchandiser of claim 11, further comprising an airfoil coupled to the base adjacent and upstream of the second air inlet, wherein the airfoil is configured to guide air toward the second air inlet.

16. A merchandiser comprising:

a case defining a primary air passageway and a secondary air passageway, the case including a base, one or more walls, and a canopy cooperatively at least partially defining a product display area and an opening through which the product display area is accessible, the base having a first air inlet and a second air inlet, and the canopy having an air outlet disposed adjacent the opening;

an evaporator disposed in the base; and a first fan disposed in the primary air passageway and configured to generate a primary airflow through the primary air passageway, the primary airflow at least partially defined by air from the product display area entering the first air inlet, and the primary airflow configured to flow through the evaporator via the primary air passageway, a second fan disposed in the secondary air passageway and configured to generate a secondary airflow through the secondary air passageway, the secondary air passageway in communication with the second air outlet and positioned to receive spillover air flowing from the product display area or the second air outlet along an exterior of a front portion of the base via the second air inlet, and wherein the secondary air passageway is positioned in the base such that the secondary airflow is configured to flow through the evaporator.

17. The merchandiser of claim 16, wherein the evaporator includes a partition defining a first section and a second section, wherein the first section is positioned in the primary air passageway and the second section is positioned in the secondary air passageway.

18. The merchandiser of claim 17, wherein the first section includes an internal structure defined by one or more of an evaporator tube orientation, an evaporator tube spacing, a fin size, or a fin spacing, wherein the second section includes an internal structure defined by one or more of an evaporator tube orientation, an evaporator tube spacing, a fin size, or a fin spacing, and wherein the internal structure of the first section is different from the internal structure of the second section.

19. The merchandiser of claim 16, further comprising an airfoil coupled to the base adjacent to and upstream of the second air inlet, the airfoil configured to guide air toward the second air inlet.

20. The merchandiser of claim 16, wherein the primary airflow and the secondary airflow combine to define a merged airflow at a location downstream of the evaporator and upstream of the air outlet.

* * * * *